US006922023B2

(12) United States Patent
Hsu et al.

(10) Patent No.: US 6,922,023 B2
(45) Date of Patent: Jul. 26, 2005

(54) MULTIPLE-LAMP BACKLIGHT INVERTER

(75) Inventors: Huang-Chang Hsu, Taoyuan (TW); Ching-Chang Hsieh, Taoyuan (TW); Chao-Jung Lin, Bade (TW); Cheng-Hsiu Lu, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 53 days.

(21) Appl. No.: 10/607,100

(22) Filed: Jun. 25, 2003

(65) Prior Publication Data

US 2004/0004450 A1 Jan. 8, 2004

(30) Foreign Application Priority Data

Jun. 26, 2002 (TW) ..... 91114030 A

(51) Int. Cl.[7] ..... H05B 37/02

(52) U.S. Cl. ..... 315/291; 315/307; 315/294; 315/276

(58) Field of Search ..... 315/291, 294, 315/300, 307, 308, 324, DIG. 5, DIG. 2, 276; H05B 37/02

(56) References Cited

U.S. PATENT DOCUMENTS 5,546,300 A * 8/1996 Lee et al. ..... 363/132
5,910,709 A * 6/1999 Stevanovic et al. ..... 315/225
6,320,329 B1 * 11/2001 Wacyk ..... 315/291
6,420,839 B1 * 7/2002 Chiang et al. ..... 315/311
6,753,660 B2 * 6/2004 Hartikka et al. ..... 315/219

* cited by examiner

*Primary Examiner*—Trinh Vo Dinh
(74) *Attorney, Agent, or Firm*—Ladas & Parry LLP

(57) ABSTRACT

An inverter for driving multiple discharge lamps. The inverter has a transformer for driving a first discharge lamp and a second discharge lamp. The inverter also includes a first balancing circuit connected in series with the first discharge lamp and a second balancing circuit connected in series with the second discharge lamp. According to a matching signal, the first and the second balancing circuits adjust a first lamp current through the first discharge lamp and a second lamp current through the second discharge lamp, respectively. A comparator is provided to receive a first sensing signal from the first balancing circuit and a second sensing signal from the second balancing circuit. Comparing the first sensing signal with the second sensing signal, the comparator generates the matching signal which controls the first and the second balancing circuits to equalize the first lamp current and the second lamp current.

24 Claims, 4 Drawing Sheets

MULTIPLE-LAMP BACKLIGHT INVERTER

BACKGROUND OF THE INVENTION

1. Field of the Invention

The invention relates to a liquid crystal display (LCD) backlight inverter. More particularly, the invention relates to an inverter for driving multiple discharge lamps in an LCD display.

2. Description of the Related Art

A liquid crystal display (LCD) monitor generally needs efficient and low profile backlighting arrangement for effective display. The backlighting arrangement is equipped with one or more discharge lamps that provide backlighting to the display. Among currently available discharge lamps, cold cathode fluorescent lamps (CCFLs) provide the highest efficiency for backlighting the display. The narrow diameter CCFL, for example, is widely used in industry.

With the increase of monitor size, multiple lamps are needed for the panel illumination. In developing the backlight inverter for multiple CCFLs, manufacturers usually prefer to use one single inverter instead of two or more in order to reduce cost and circuit complexity. FIG. 1 shows a perspective view of a dual-lamp display. A display housing 10 encloses an LCD panel 20 and two CCFLs LP10, LP12. These two CCFLs LP10 and LP12 are located at opposite sides of the LCD panel 20. Note that capacitors C10, C12 appear with their lamp load LP10 and LP12 in parallel across a transformer T10's secondary winding. The advantages of the parallel structure in FIG. 1 are low cost and clear modularity. To achieve equal illumination, the transformer T10's secondary current output must be split evenly between the C10-LP10 and C12-LP12 branches. However, layout and component matching preclude a perfect current split, so the lamps LP10 and LP12 tend to receive unequal current. This causes illumination imbalance in the lamps. In addition, any change in lamp characteristics (e.g., aging) can cause current imbalance. Such a condition expedites lamp aging and shortens lamp life. Accordingly, what is needed is a backlight inverter for driving multiple discharge lamps that overcomes the problems of the prior art.

SUMMARY OF THE INVENTION

It is an object of the present invention to provide an inverter for driving multiple discharge lamps that is capable of equalizing lamp currents to ensure long lamp life.

It is another object of the present invention to provide a compact and economic inverter with balancing circuits for driving multiple discharge lamps in an LCD backlight module.

The present invention is generally directed to an inverter for driving multiple discharge lamps. According to one aspect of the invention, the inverter includes a transformer, a first balancing circuit, a second balancing circuit and a comparator. The transformer is adapted to drive a first discharge lamp and a second discharge lamp. The first balancing circuit, connected in series with the first discharge lamp, senses a first lamp current through the first discharge lamp to provide a first sensing signal. The second balancing circuit, connected in series with the second discharge lamp, senses a second lamp current through the second discharge lamp to provide a second sensing signal. The comparator receives the first and the second sensing signals. Comparing the first sensing signal with the second sensing signal, the comparator generates a matching signal to control the first and the second balancing circuits. In accordance with the matching signal, the first and the second balancing circuits adjust the first lamp current and the second lamp current respectively, thereby equalizing the first lamp current and the second lamp current.

Preferably, the first balancing circuit includes a first transistor circuit and the second balancing circuit includes a second transistor circuit. In response to the matching signal in a first state, the first transistor circuit decreases the first lamp current and the second transistor circuit increases the second lamp current, respectively. In response to the matching signal in the second state, the first transistor circuit increases the first second lamp current and the second transistor circuit decreases the second lamp current, respectively.

Further, the inverter of the invention includes a resonant push-pull converter and drive circuitry. The resonant push-pull converter contains a transformer having a primary winding and a secondary winding, which, in a push-pull manner, generates an AC voltage at the secondary winding to drive the first and the second discharge lamps in parallel. The input of the drive circuitry receives a DC voltage and the output of the drive circuitry is coupled to the transformer's primary winding. In accordance with the first sensing signal, the drive circuitry controls the resonant push-pull converter to regulate the AC voltage.

According to another aspect of the invention, an inverter capable of driving multiple discharge lamps is made up of a transformer, a plurality of balancing circuits, and a comparator. The transformer is adapted to drive a plurality of discharge lamps. The balancing circuits are connected in series with the corresponding discharge lamps, respectively. They sense respective lamp currents through their corresponding discharge lamps to provide a plurality of sensing signals. The comparator compares the sensing signals to generate a set of matching signals controlling the balancing circuits. In accordance with the matching signal set, the balancing circuits adjust the respective lamp currents, thereby equalizing the lamp currents among the discharge lamps. Preferably, each of the balancing circuits includes a transistor circuit in response to the corresponding matching signal set. When one of the matching signals indicates that its corresponding lamp current is the largest of all, the corresponding transistor circuit decreases the largest lamp current and the rest of the transistor circuits increase the other lamp currents.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF THE INVENTION

Figure 1:
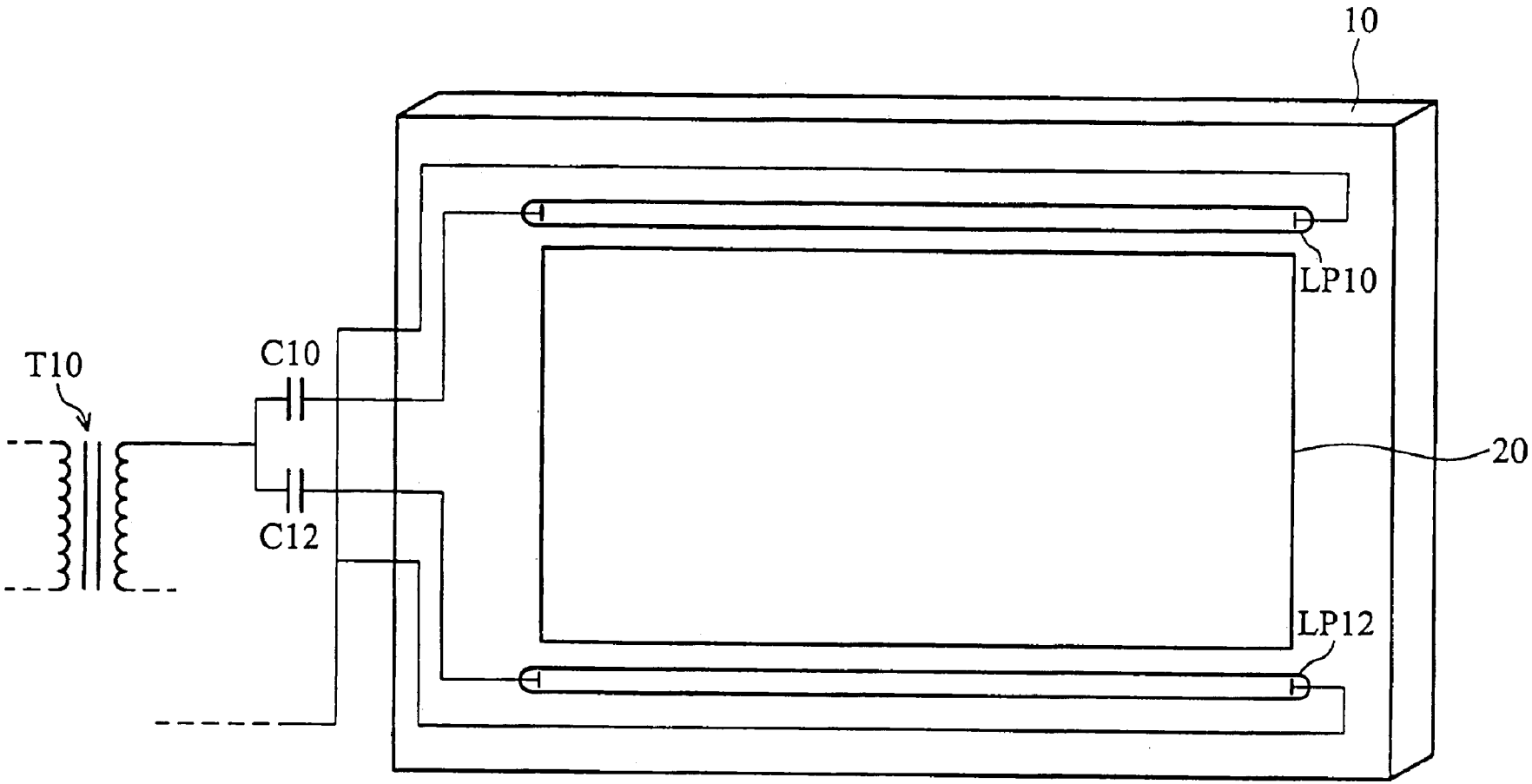
FIG. 1 (PRIOR ART)
FIG. 1 is a perspective diagram of an exemplary dual-lamp display.
Figure 2:
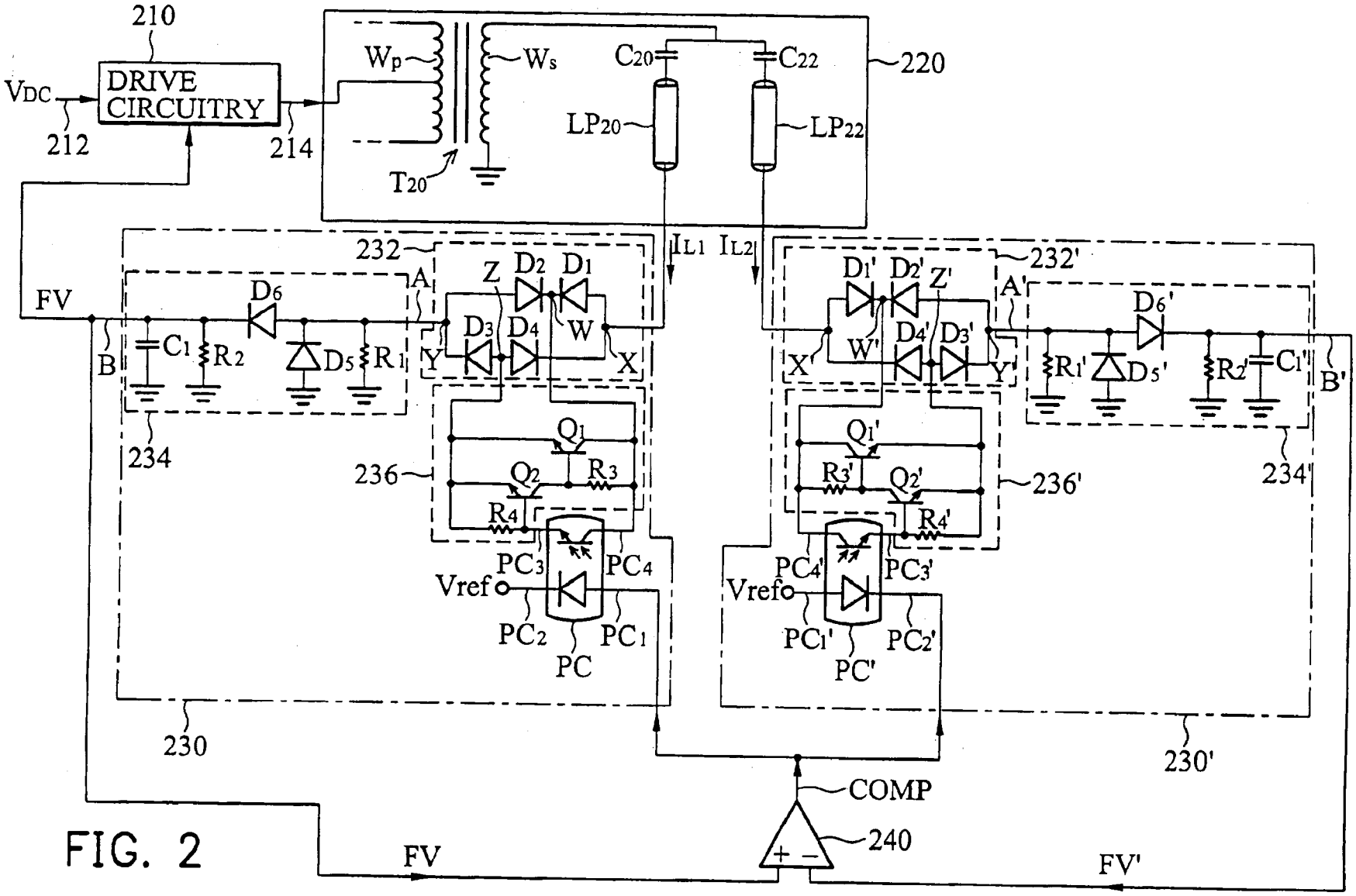
FIG. 2 is a schematic diagram of a preferred embodiment according to the invention.

Referring to FIG. 2, the input 212 of drive circuitry 210 receives a direct current (DC) voltage $V_{DC}$. A resonant push-pull converter 220 includes a transformer T20 as shown in FIG. 2. A primary winding $W_P$ of the transformer T20 is provided with a center tap coupled to the output 214 of the drive circuitry 210. The transformer T20's secondary winding $W_S$ is coupled to a parallel connection of the lamps LP20 and LP22. The resonant push-pull converter 220 generates a high alternating current (AC) voltage in a push-pull manner to drive discharge lamps LP20 and LP22 in parallel. A ballast capacitor C20 is coupled in series between the secondary winding $W_S$ and the lamps LP20. Likewise, a ballast capacitor C22 is coupled in series between the secondary winding $W_S$ and the lamps LP22. The resonant push-pull converter 220 is employed to convert the relative low DC voltage $V_{DC}$ to a higher AC voltage for lamp ignition. According to the invention, the resonant push-pull converter 220 is representative of a Royer converter.

A balancing circuit 230 is connected in series with the lamp LP20. Also, a balancing circuit 230' is connected in series with the lamp LP22. The balancing circuit 230 provides a sensing signal FV as feedback to the drive circuitry 210. Under control of the drive circuitry 210, the resonant push-pull converter 220 regulates the AC output voltage. Moreover, the drive circuitry 210 can vary the AC voltage applied to the lamps LP20 and LP22 for the purpose of dimming control. In accordance with a matching signal COMP, the balancing circuits 230 and 230' further adjust lamp currents $I_{L1}$ and $I_{L2}$ flowing through the lamps LP20 and LP22, respectively. A comparator 240 receives the sensing signal FV from the balancing circuit 230 and the sensing signal FV' from the balancing circuit 230'. Comparing the sensing signal FV with the sensing signal FV', the comparator 240 generates the matching signal COMP to control the balancing circuits 230 and 230', thereby equalizing the lamp currents $I_{L1}$ and $I_{L2}$. When the sensing signal FV is greater than the sensing signal FV', the comparator 240 drives the matching signal COMP to a first state (logic high). When the sensing signal FV is less than the sensing signal FV', the comparator 240 drives the matching signal COMP to a second state (logic low).

As shown in FIG. 2, the balancing circuit 230 includes a rectifier circuit 232, a sensing circuit 234 and a transistor circuit 236. Also, the balancing circuit 230' includes a rectifier circuit 232', a sensing circuit 234' and a transistor circuit 236'. The rectifier circuits 232 and 232' are full-wave bridge circuits formed by diodes D1~D4 and D1'~D4', respectively, which provide DC voltages for biasing the transistor circuits 236 and 236'. The input port's terminal X of the rectifier circuit 232 is coupled to the lamp LP20 and the input port's terminal Y of the rectifier circuit 232 is coupled to an input terminal A of the sensing circuit 234. The output port's terminals W and Z of the rectifier circuit 232 are coupled across the transistor circuit 236. On the other hand, the input port's terminal X' of the rectifier circuit 232' is coupled to the lamp LP22 and the input port's terminal Y' of the rectifier circuit 232' is coupled to an input terminal A' of the sensing circuit 234'. The output port's terminals W' and Z' of the rectifier circuit 232' are coupled across the transistor circuit 236'. The comparator 240 has its non-inverting input terminal "+" coupled to an output terminal B of the sensing circuit 234 and its inverting input terminal "−" coupled to an output terminal B' of the sensing circuit 234'. The sensing circuit 234 is made up of resistors R1~R2, diodes D5~D6, and a capacitor C1. Similarly, the sensing circuit 234' is made up of resistors R1'~R2', diodes D5'~D6', and a capacitor C1'. As such, the sensing circuits 234 and 234' can sense the lamp currents $I_{L1}$, $I_{L2}$ to provide the sensing signals FV and FV', respectively.

Still referring to FIG. 2, the balancing circuits 230 and 230' include coupling devices PC and PC', respectively, to protect against noise from the comparator 240. The coupling device PC is connected between the comparator 240 and the transistor circuit 236. The coupling device PC' is connected between the comparator 240 and the transistor circuit 236'. According to the invention, the coupling device is either a photocoupler or relay featuring high isolation and noise elimination. Transistors as illustrated hereinafter may represent, but are not limited to, for example, a Bipolar Junction Transistor (BJT), Junction Field-Effect Transistor (JFET) or Metal-Oxide-Semiconductor Field-Effect Transistor (MOSFET). In this case, photocouplers and BJTs are used for illustration. As depicted, the transistor circuit 236 is made up of transistors Q1, Q2 and resistors R3, R4. The collector and emitter of Q1 are connected across the output port of the rectifier circuit 232. The collector and emitter of Q2 are connected across the base and emitter of Q1. The resistor R3 is connected across the collector and base of Q1 and the resistor R4 is connected across the base and emitter of Q2. One output terminal $PC_3$ of the photocoupler PC is connected to the base of Q2 and the other output terminal $PC_4$ of the photocoupler PC is connected to the collector of Q1. One input terminal $PC_1$ of the photocoupler PC receives the matching signal COMP and the other input terminal $PC_2$ of the photocoupler PC is coupled to a reference voltage $V_{ref}$. On the other hand, the transistor circuit 236' is made up of transistors Q1', Q2' and resistors R3', R4'. In a similar manner, the collector and emitter of Q1' are connected across the output port of the rectifier circuit 232'. The collector and emitter of Q2' are connected across the base and emitter of Q1'. The resistor R3' is connected across the collector and base of Q1' and the resistor R4' is connected across the base and emitter of Q2'. One output terminal $PC_3'$ of the photocoupler PC' is connected to the base of Q2' and the other output terminal $PC_4'$ of the photocoupler PC' is connected to the collector of Q1'. One input terminal $PC_2'$ of the photocoupler PC' receives the matching signal COMP and the other input terminal $PC_1'$ of the photocoupler PC' is coupled to the reference voltage $V_{ref}$. The reference voltage $V_{ref}$ is set to one-half of a system voltage Vcc (not shown) for proper working of the photocouplers PC and PC'. Preferably, the balancing circuits 230, 230', as well as their associated rectifier circuits, sensing circuits and transistor circuits, have substantially the same arrangements.

When the lamp current $I_{L1}$ is greater than the lamp current $I_{L2}$, the comparator 240 can generate the COMP signal of logic high according to the sensing signals FV and FV'. In response to the COMP signal of logic high, the photocoupler PC is made conductive between its output terminals so that Q2 is in saturation. Thus, the base current of Q1 is very nearly zero and the voltage drop across the collector and emitter of Q1 is high enough to drive Q1 into breakdown so as to suppress the lamp current $I_{L1}$. In the meantime, the photocoupler PC' is made non-conductive between its output terminals so that Q2' is cut off and Q1' operates in the active region. Thus, the resistance between the collector and emitter of Q1' is decreased so the lamp current $I_{L2}$ is increased. Conversely, the comparator 240 generates the COMP signal of logic low according to the sensing signals FV and FV' when the lamp current $I_{L1}$ is less than the lamp current $I_{L2}$. In response to the COMP signal of logic low, the photocoupler PC is made non-conductive between its output terminals so that Q2 is cut off and Q1 operates in the active region. Thus, the resistance between the collector and emitter of Q1 is decreased so the lamp current $I_{L1}$ is increased. Meanwhile, the photocoupler PC' are made conductive between its output terminals so that Q2' is in saturation. Thus, the base current of Q1' is very nearly zero and the voltage drop across the collector and emitter of Q1' is high enough to drive Q1' into breakdown so as to suppress the lamp current $I_{L2}$. In this way, the lamp currents $I_{L1}$, $I_{L2}$ in the discharge lamps LP20 and LP22 are equalized eventually.

Figure 3A:
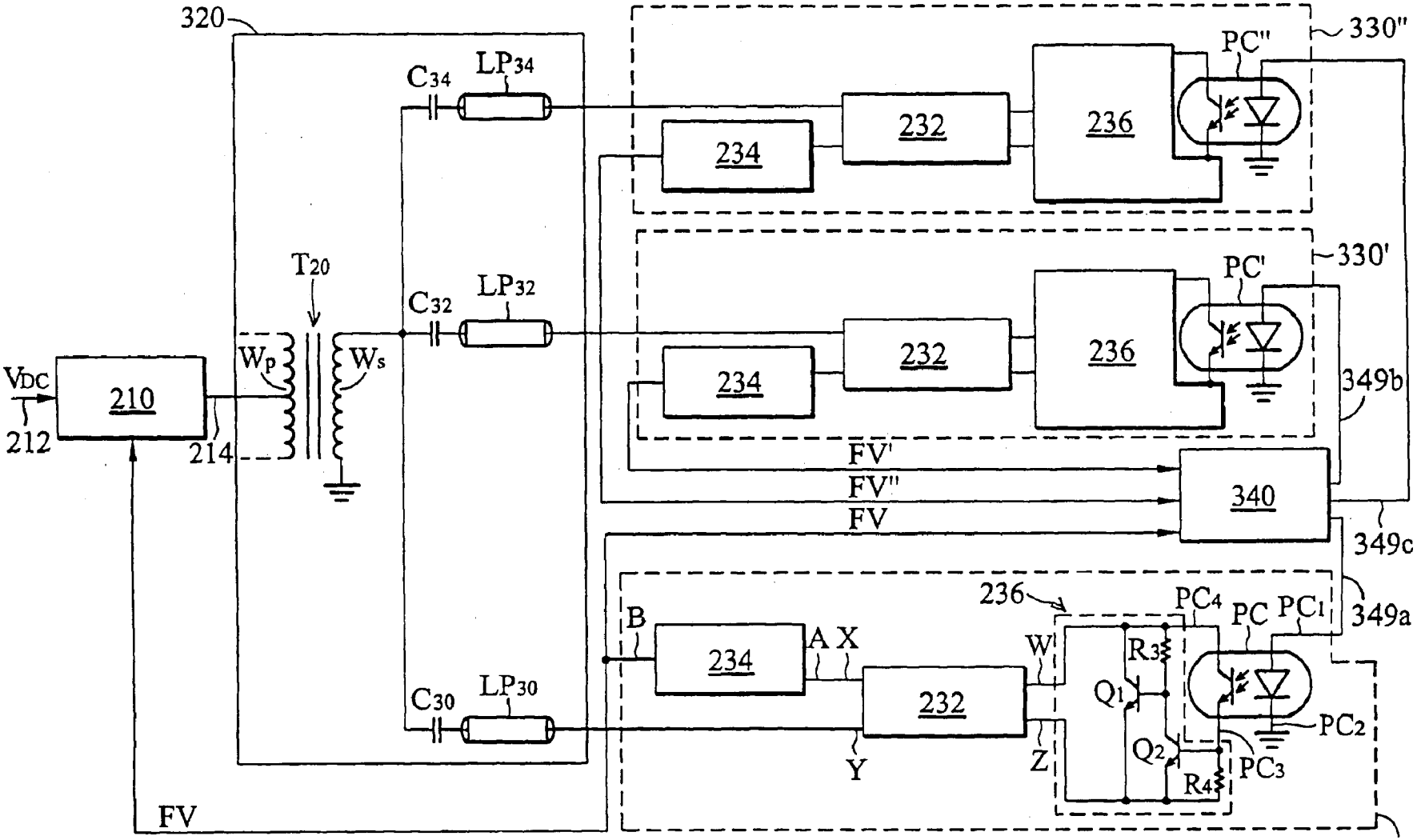
FIG. 3A is a block schematic diagram of an alternative embodiment according to the invention.

FIG. 3A illustrates an alternative embodiment for, but is not limited to, three discharge lamps in accordance with the invention. Note that similar reference numbers identify like components in FIG. 2 and FIG. 3A. As depicted, the input 212 of drive circuitry 210 receives a direct current (DC) voltage $V_{DC}$. In a resonant push-pull converter 320, a transformer T20's primary winding $W_P$ is provided with a center tap coupled to the output 214 of the drive circuitry 210. The transformer T20's secondary winding $W_S$ is coupled to a parallel connection of the lamps LP30~LP34. The resonant push-pull converter 320 generates a high alternating current (AC) voltage in a push-pull manner to drive discharge lamps LP30, LP32 and LP34 in parallel. A ballast capacitor C30 is coupled in series between the secondary winding $W_S$ and the lamps LP30. Likewise, ballast capacitors C32 and C34 are arranged in the same manner. Balancing circuits 330, 330' and 330" are connected in series with the corresponding lamps LP30, LP32 and LP34, respectively. They sense respective lamp currents $I_{L1}$, $I_{L2}$ and $I_{L3}$ through their corresponding discharge lamps LP30, LP32 and LP34 to provide three sensing signals FV, FV' and FV". A comparison circuit 340 compares the sensing signals FV, FV' and FV" to generate a set of matching signals COMP1~COMP3 controlling the balancing circuits 330, 330' and 330". In accordance with the matching signal set, the balancing circuits 330, 330' and 330" adjust the respective lamp currents $I_{L1}$, $I_{L2}$ and $I_{L3}$, thereby equalizing the lamp currents among the discharge lamps LP30, LP32 and LP34. In this case, the balancing circuit 330 provides its sensing signal FV as feedback to the drive circuitry 210 so as to control the resonant push-pull converter 220 to regulate the AC output voltage.

Preferably, the balancing circuits 330, 330' and 330" have substantially the same arrangements. Each balancing circuit includes a rectifier circuit, a sensing circuit and a transistor circuit and a photocoupler. Taking the balancing circuits 330 as an example, the input port's terminal X of the rectifier circuit 232 is coupled to the lamp LP30 and the input port's terminal Y of the rectifier circuit 232 is coupled to an input terminal A of the sensing circuit 234. The output port's terminals W and Z of the rectifier circuit 232 are coupled across the transistor circuit 236. An input terminal A of the sensing circuit 234 provides the sensing signal FV to a corresponding terminal of the comparison circuit 340. In the transistor circuit 236, the collector and emitter of Q1 are connected across the output port of the rectifier circuit 232. The collector and emitter of Q2 are connected across the base and emitter of Q1. The resistor R3 is connected across the collector and base of Q1 and the resistor R4 is connected across the base and emitter of Q2. One output terminal $PC_3$ of the photocoupler PC is connected to the base of Q2 and the other output terminal $PC_4$ of the photocoupler PC is connected to the collector of Q1. One input terminal $PC_1$ of the photocoupler PC is connected to an output terminal 349*a* of the comparison circuit 340 and the other input terminal PC2 of the photocoupler PC is coupled to ground.

Figure 3B:
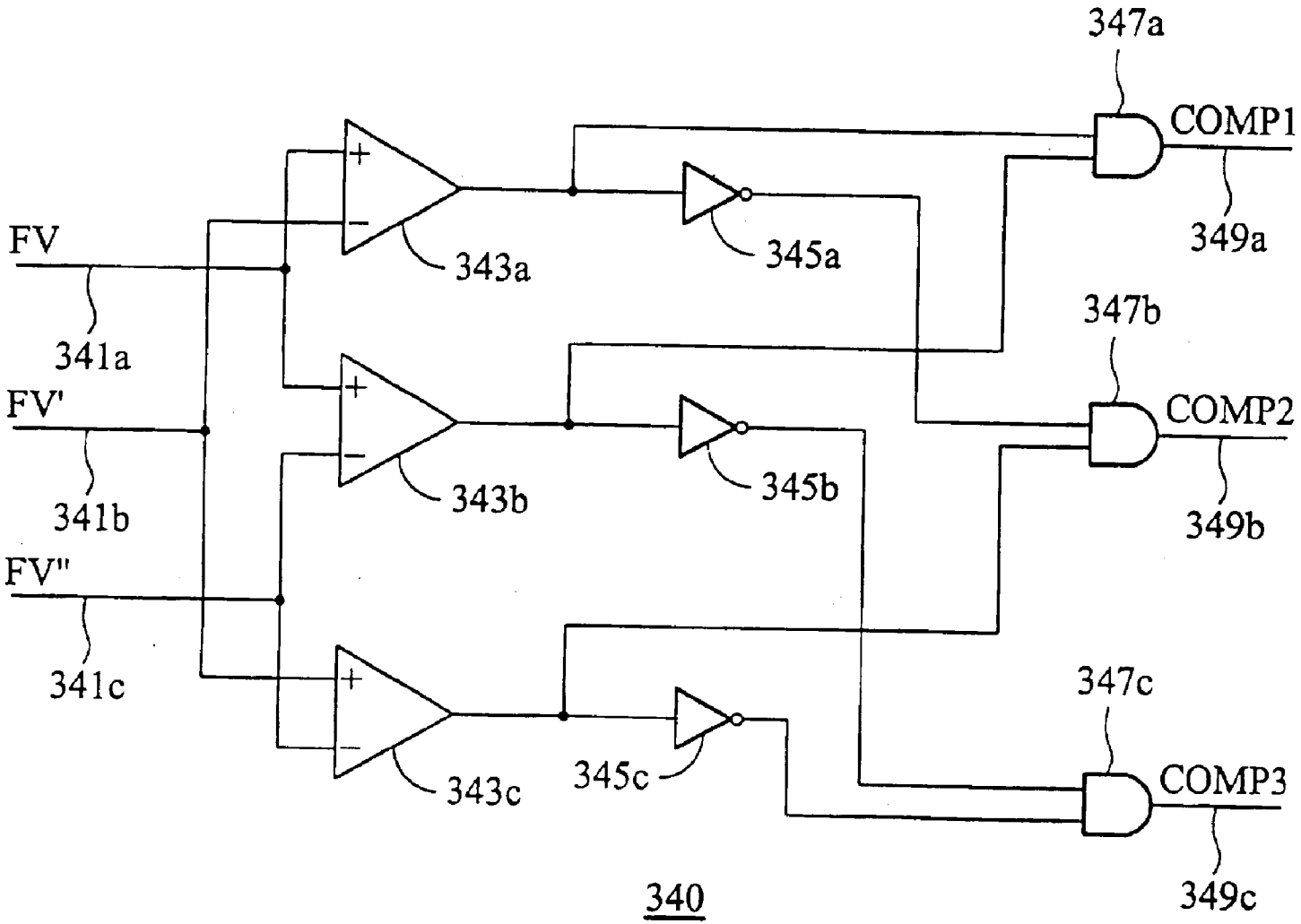
FIG. 3B is a logic block diagram illustrating a comparison circuit of FIG. 3A.

Turning now to FIG. 3B, the comparison circuit 340 is made up of comparators 340*a*~340C, AND gates 347*a*~347*c* and NOT gates 345*a*~345*c*, in which the AND gates and NOT gates form a combinational circuit. The comparison circuit 340 has its input terminals 341*a*~341*c* coupled to the sensing circuits to receive the sensing signals FV, FV' and FV", respectively. On the other hand, the comparison circuit 340 has its output terminals 349*a*~349*c* coupled to the photocouplers and outputs the matching signal set COMP1~COMP3, respectively. When the sensing signal FV is greater than the sensing signals FV' and FV", the comparison circuit 340 drives the COMP1 signal to logic high and drives the COMP2 and COMP3 signals to logic low. In other words, the COMP1 signal indicates that its corresponding current $I_{L1}$ is the largest of all. Consequently, the photocoupler PC is made conductive between its output terminals, while the photocouplers PC' and PC" are made non-conductive between their respective output terminals. Thus, the transistor circuit in the balancing circuit 330 decreases the current $I_{L1}$, as described previously, while the transistor circuits in the balancing circuits 330' and 330" separately increases the currents $I_{L2}$ and $I_{L3}$. When the sensing signal FV' is greater than the sensing signals FV and FV", the comparison circuit 340 drives the COMP2 signal to logic high and drives the COMP1 and COMP3 signals to logic low. In this regard, the COMP2 signal indicates that its corresponding current $I_{L2}$ is the largest of all. Therefore, the photocoupler PC' is made conductive between its output terminals, while the photocouplers PC and PC" are made non-conductive between their respective output terminals. As a result, the transistor circuit in the balancing circuit 330' decreases the current $I_{L2}$, while the transistor circuits in the balancing circuits 330 and 330" separately increase the currents $I_{L1}$, and $I_{L3}$. Similarly, when the sensing signal FV" is greater than the sensing signals FV and FV', the comparison circuit 340 drives the COMP3 signal to logic high and drives the COMP1 and COMP2 signals to logic low. As such, the COMP3 signal indicates that its corresponding current $I_{L3}$ is the largest of all. The photocoupler PC" is thus made conductive between its output terminals, while the photocouplers PC and PC' are made non-conductive between their respective output terminals. Hence, the transistor circuit in the balancing circuit 330" decreases the current $I_{L3}$, while the transistor circuits in the balancing circuits 330 and 330' separately increase the currents $I_{L1}$ and $I_{L2}$ Eventually, current and illumination balance in the lamps LP30, LP32, and LP34 is accomplished in this manner.

Accordingly, the present invention discloses an inverter for driving multiple discharge lamps that is capable of equalizing lamp currents to enhance the lamp life. Owing to the balancing circuits, the wiring layout of these multiple-lamp designs is very easy and multiple-lamp displays can be driven with more economical backlight circuitry.

While the invention has been described by way of example and in terms of the preferred embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An inverter for driving multiple discharge lamps comprising:

a transformer for driving a first discharge lamp and a second discharge lamp, comprising primary and secondary windings;

a first balancing circuit connected in series with the first discharge lamp, sensing a first lamp current through the first discharge lamp to provide a first sensing signal, for adjusting the first lamp current in accordance with a matching signal;

a second balancing circuit connected in series with the second discharge lamp, sensing a second lamp current through the second discharge lamp to provide a second sensing signal, for adjusting the second lamp current in accordance with the matching signal; and a comparator receiving the first and the second sensing signals, for comparing the first sensing signal with the second sensing signal to generate the matching signal used to control the first and the second balancing circuits, thereby equalizing the first lamp current and the second lamp current.

2. The inverter as recited in claim 1 wherein the comparator drives the matching signal to a first state when the first sensing signal is greater than the second sensing signal and drives the matching signal to a second state when the first sensing signal is less than the second sensing signal.

3. The inverter as recited in claim 2 wherein the first balancing circuit comprises a first transistor circuit, in response to the matching signal, for decreasing the first lamp current when the matching signal is in the first state, and for increasing the first lamp current when the matching signal is in the second state.

4. The inverter as recited in claim 2 wherein the second balancing circuit comprises a second transistor circuit, in response to the matching signal, for increasing the second lamp current when the matching signal is in the first state, and for decreasing the second lamp current when the matching signal is in the second state.

5. The inverter as recited in claim 3 wherein the first balancing circuit further comprises a first coupling device connected between the comparator and the first transistor circuit, for protecting against noise from the comparator.

6. The inverter as recited in claim 4 wherein the second balancing circuit further comprises a second coupling device connected between the comparator and the second transistor circuit, for protecting against noise from the comparator.

7. The inverter as recited in claim 3 wherein the first balancing circuit further comprises a first rectifier circuit having an input port and an output port, where one terminal of the input port is coupled to the first discharge lamp and terminals of the output port are coupled across the first transistor circuit.

8. The inverter as recited in claim 4 wherein the second balancing circuit further comprises a second rectifier circuit having an input port and an output port, where one terminal of the input port is coupled to the second discharge lamp and terminals of the output port are coupled across the second transistor circuit.

9. The inverter as recited in claim 7 wherein the first balancing circuit further comprises a first sensing circuit for sensing the first lamp current through the first discharge lamp to provide the first sensing signal, in which the first sensing circuit has its input terminal coupled to the other terminal of the first rectifier circuit's input port and has its output terminal coupled to a first input terminal of the comparator.

10. The inverter as recited in claim 8 wherein the second balancing circuit further comprises a second sensing circuit for sensing the second lamp current through the second discharge lamp to provide the second sensing signal, in which the second sensing circuit has its input terminal coupled to the other terminal of the second rectifier circuit's input port and has its output terminal coupled to a second input terminal of the comparator.

11. The inverter as recited in claim 1 further comprising:

a resonant push-pull converter, including the transformer generating an AC voltage in a push-pull manner at the secondary winding to drive the first and the second discharge lamps in parallel; and drive circuitry for controlling the resonant push-pull converter to regulate the AC voltage in accordance with the first sensing signal, in which the input of the drive circuitry receives a DC voltage and the output of the drive circuitry is coupled to the transformer's primary winding.

12. An inverter for driving multiple discharge lamps comprising:

a resonant push-pull converter, including a transformer having a primary winding and a secondary winding that is coupled to a parallel connection of a first and second discharge lamp, for generating an AC voltage in a push-pull manner at the secondary winding to drive the first and the second discharge lamps in parallel;

a first balancing circuit connected in series with the first discharge lamp, sensing a first lamp current through the first discharge lamp to provide a first sensing signal, for adjusting the first lamp current in accordance with a matching signal;

a second balancing circuit connected in series with the second discharge lamp, sensing a second lamp current through the second discharge lamp to provide a second sensing signal, for adjusting the second lamp current in accordance with the matching signal;

a comparator receiving the first and the second sensing signals, for comparing the first sensing signal with the second sensing signal to generate the matching signal used to control the first and the second balancing circuits, thereby equalizing the first lamp current and the second lamp current; and drive circuitry for controlling the resonant push-pull converter to regulate the AC voltage in accordance with the first sensing signal, in which the input of the drive circuitry receives a DC voltage and the output of the drive circuitry is coupled to the transformer's primary winding.

13. The inverter as recited in claim 12 wherein the comparator drives the matching signal to a first state when the first sensing signal is greater than the second sensing signal and drives the matching signal to a second state when the first sensing signal is less than the second sensing signal.

14. The inverter as recited in claim 13 wherein the first balancing circuit comprises a first transistor circuit and the second balancing circuit comprises a second transistor circuit, wherein the first transistor circuit decreases the first lamp current and the second transistor circuit increases the second lamp current respectively in response to the matching signal in the first state, and wherein the first transistor circuit increases the first second lamp current and the second transistor circuit decreases the second lamp current respectively in response to the matching signal in the second state.

15. The inverter as recited in claim 14 wherein the first balancing circuit further comprises a first coupling device and the second balancing circuit further comprises a second coupling device, for respectively protecting against noise from the comparator, wherein the first coupling device is connected between the comparator and the first transistor circuit, and wherein the second coupling device is connected between the comparator and the second transistor circuit.

16. The inverter as recited in claim 14 wherein the first balancing circuit further comprises a first rectifier circuit and the second balancing circuit further comprises a second rectifier circuit, wherein one terminal of the first rectifier circuit's input port is coupled to the first discharge lamp and terminals of the first rectifier circuit's output port are coupled across the first transistor circuit, and wherein one terminal of the second rectifier circuit's input port is coupled to the second discharge lamp and terminals of the second rectifier circuit's output port are coupled across the second transistor circuit.

17. The inverter as recited in claim 16 wherein the first balancing circuit further comprises a first sensing circuit for sensing the first lamp current through the first discharge lamp to provide the first sensing signal, in which the first sensing circuit has its input terminal coupled to the other terminal of the first rectifier circuit's input port and has its output terminal coupled to a first input terminal of the comparator.

18. The inverter as recited in claim 16 wherein the second balancing circuit further comprises a second sensing circuit for sensing the second lamp current through the second discharge lamp to provide the second sensing signal, in which the second sensing circuit has its input terminal coupled to the other terminal of the second rectifier circuit's input port and its output terminal coupled to a second input terminal of the comparator.

19. An inverter for driving multiple discharge lamps comprising:

a transformer for driving a plurality of discharge lamps, comprising primary and secondary windings;

a plurality of balancing circuits respectively connected in series with the corresponding discharge lamps, sensing respective lamp currents through their corresponding discharge lamps to provide a plurality of sensing signals, for adjusting the lamp currents in accordance with a set of matching signals; and a comparator for comparing the sensing signals from the balancing circuits to generate the set of matching signals used to control the balancing circuits, thereby equalizing the lamp currents among the discharge lamps.

20. The inverter as recited in claim 19 wherein each of the balancing circuits comprises a transistor circuit in response to the corresponding matching signal set, when one of the matching signals indicates that its corresponding lamp current is the largest of all, the corresponding transistor circuit decreases the largest lamp current and the rest of the transistor circuits increase the other lamp currents.

21. The inverter as recited in claim 20 wherein each of the balancing circuits further comprises a coupling device connected between the comparator and its associated transistor circuit, for protecting against noise from the comparator.

22. The inverter as recited in claim 21 wherein each of the balancing circuits further comprises a rectifier circuit having an input port and an output port, where one terminal of each rectifier circuit's input port is coupled to the corresponding discharge lamp and terminals of each rectifier circuit's output port are coupled across its associated transistor circuit.

23. The inverter as recited in claim 22 wherein each of the balancing circuits further comprises a sensing circuit for sensing the corresponding lamp current to provide the respective sensing signal, in which each sensing circuit has its input terminal coupled to the other terminal of its associated rectifier circuit's input port and has its output terminal coupled to a corresponding terminal of the comparator.

24. The inverter as recited in claim 19 further comprising:

a resonant push-pull converter, including the transformer generating an AC voltage in a push-pull manner at the secondary winding to drive the discharge lamps in parallel; and drive circuitry for controlling the resonant push-pull converter to regulate the AC voltage in accordance, with the one of the sensing signals, in which the input of the drive circuitry receives a DC voltage and the output of the drive circuitry is coupled to the transformer's primary winding.

* * * * *